US006308416B1

(12) United States Patent
Bosy et al.

(10) Patent No.: US 6,308,416 B1
(45) Date of Patent: Oct. 30, 2001

(54) SURFACE CONFORMING SHAVING RAZOR AND HANDLE THEREFOR

(75) Inventors: Brian J. Bosy, Framingham; Alexander T. Chenvainu, Brookline; Franco Lodato, Walpole; David L. Pappas, Waltham, all of MA (US); Rajan Ramaswamy, Sant Cugat Barcelona (ES)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/223,938

(22) Filed: Dec. 31, 1998

(51) Int. Cl.[7] ..... B26B 21/22; B26B 21/52
(52) U.S. Cl. ..... 30/50; 30/527
(58) Field of Search ..... 30/50, 527, 529, 30/530; D28/46

(56) References Cited

U.S. PATENT DOCUMENTS

| | | | | |
|---|---|---|---|---|
| D. 260,944 | | 9/1981 | Gray | D28/46 |
| D. 346,880 | | 5/1994 | Meisner et al. | D28/48 |
| D. 351,925 | | 10/1994 | Meisner et al. | D28/48 |
| D. 352,568 | | 11/1994 | Meisner et al. | D28/48 |
| D. 354,586 | | 1/1995 | Grange | D28/46 |
| D. 355,049 | | 1/1995 | Yasui | D28/48 |
| D. 381,121 | | 7/1997 | Shurtleff et al. | D28/46 |
| D. 385,659 | | 10/1997 | Shurtleff | D28/48 |
| D. 386,821 | | 11/1997 | Shurtleff et al. | D28/48 |
| 2,587,964 | * | 3/1952 | Burns | 30/527 |
| 3,950,848 | | 4/1976 | Goldstein . | |
| 4,347,663 | * | 9/1982 | Ullmo | 30/527 |
| 4,392,303 | * | 7/1983 | Ciaffone | 30/527 |
| 4,501,066 | * | 2/1985 | Sceberras | 30/50 |
| 4,754,548 | | 7/1988 | Solow | 30/50 |
| 4,791,724 | | 12/1988 | Dumas . | |
| 5,031,319 | | 7/1991 | Althaus et al. | 30/85 |
| 5,038,472 | * | 8/1991 | Iderosa | 30/527 |
| 5,157,835 | | 10/1992 | Lazarchik et al. | 30/85 |
| 5,307,564 | * | 5/1994 | Schoenberg | 30/50 |
| 5,426,853 | | 6/1995 | McNinch | 30/89 |
| 5,497,551 | | 3/1996 | Apprille, Jr. | 30/85 |
| 5,678,316 | * | 10/1997 | Althaus et al. | 30/527 |
| 5,687,485 | | 11/1997 | Shurtleff et al. | 30/526 |
| 5,787,593 | * | 8/1998 | Althaus | 30/527 |
| 5,953,825 | * | 9/1999 | Christman et al. | 30/527 |

FOREIGN PATENT DOCUMENTS

| | | |
|---|---|---|
| 0 418 726 A2 | 9/1989 | (EP) . |
| WO8906587A | 7/1989 | (WO) . |
| WO 97/09155 | 3/1997 | (WO) . |
| WO 97/44164 | 11/1997 | (WO) . |

OTHER PUBLICATIONS

International Search Report PCT/US99/31091.
Photographs of Silk Effects prior art razor.

* cited by examiner

*Primary Examiner*—Hwei-Siu Payer
(74) *Attorney, Agent, or Firm*—Fish & Richardson P.C.

(57) ABSTRACT

A shaving razor including a handle and three blade units each connected to the handle by a respective mounting structure that provides a pivotal connection of the blade unit to the mounting structure about a pivot axis that is transverse to the cutting edge, and also provides controlled up and down movement of the blade unit thereby permitting each blade unit to conform to the contour of a surface being shaved. The handle has an index finger indent on a top surface, and thumb indent on the bottom surface, and is shaped to match the curvature of a user's hand.

38 Claims, 9 Drawing Sheets

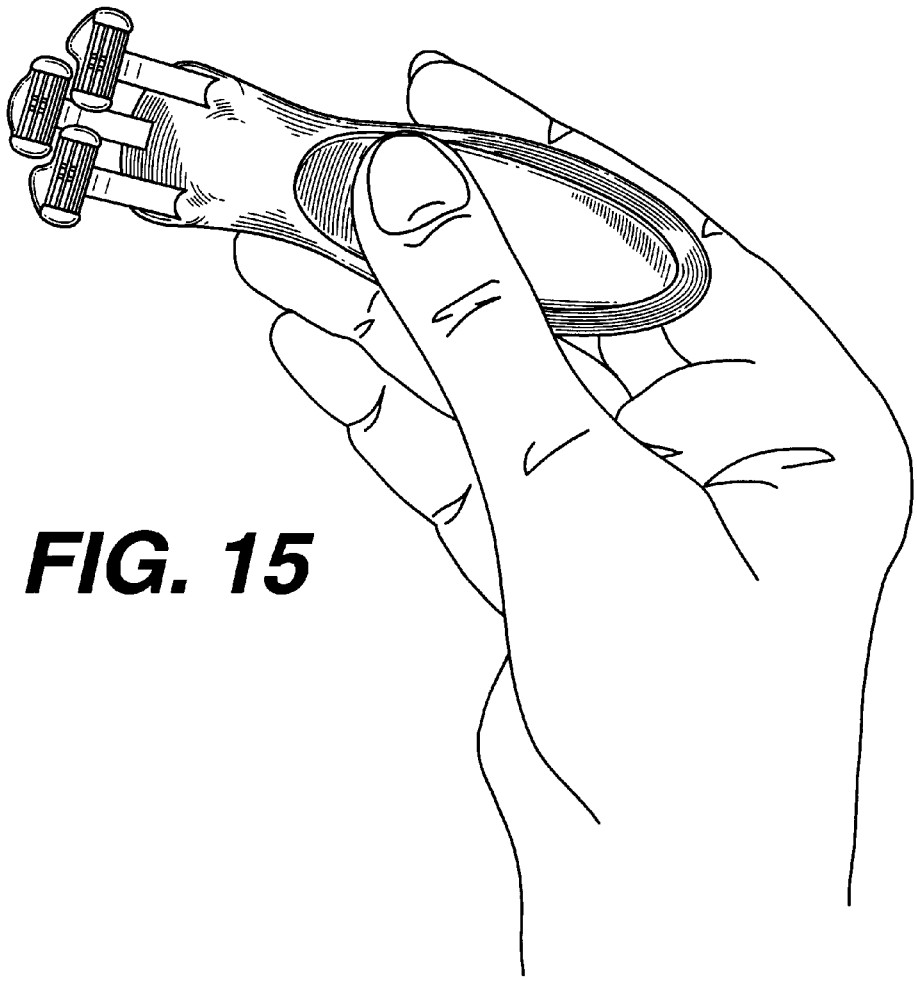
FIG. 15
FIG. 16
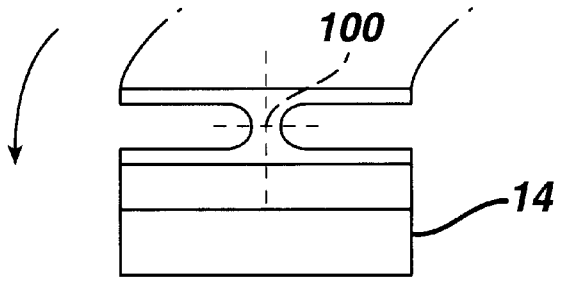

SURFACE CONFORMING SHAVING RAZOR AND HANDLE THEREFOR

BACKGROUND OF THE INVENTION

The invention relates to a shaving razor that conforms to the surface being shaved.

Shaving razors typically have straight cutting edges, while the surfaces being shaved having varying degrees of flatness or curvature and varying abilities to deform to provide a flat surface for the straight edge of the razor. Shaving an area of the body with pronounced curvature, e.g., an ankle or knee, using a razor having a straight cutting edge results in a localized area of contact. This requires repeated strokes to shave the entire area, and causes a high stress concentration at the localized area of contact, which can increase the possibility of a nick or cut at that area.

SUMMARY OF THE INVENTION

In one aspect, the invention features, in general, a shaving razor including a handle, three blade units that are mounted at the end of the handle, and a mounting structure connecting each blade unit to the handle. Each blade unit includes a guard, at least one blade having a cutting edge, and a cap. The mounting structure provides a pivotal connection of the blade unit to the mounting structure about a pivot axis that is transverse to the cutting edge, and also provides up and down movement of the blade unit along a displacement direction that is transverse to a plane through the guard and cap, thereby permitting each blade unit to conform to the contour of a surface being shaved.

In another aspect, the invention features, in general a shaving razor including a handle and a blade unit that is mounted at the end of the handle by a parallelogram, four-bar linkage made of an integral plastic piece including two elongated members, a proximal end member connected to the handle, and a distal end member connected to the blade unit. The elongated members and proximal and distal end members are pivotally connected to each other via resilient living hinges permitting up and down movement of the blade unit.

In another aspect the invention features, in general, a shaving razor including a handle and three blade units that are mounted at the end of the handle by a mounting structure. The cutting edges of blades of two of the blade units are generally aligned with each other and have a gap between them, and the third blade unit is offset with respect to the other two, with its blade overlapping the gap. The aligned blade units have facing cutout portions in respective caps, and the third blade unit is partially located in the region of the cutout portions.

Embodiments of the invention may include one or more of the following features. The mounting structure for each blade unit is independent of mounting structures for the other blade units, permitting each blade unit to pivot about a respective pivot axis and to be displaced along a respective displacement axis independently of the pivoting and displacement of the other blade units. The integral plastic piece of the four-bar linkage has an at rest position in which the elongated members are spaced from each other and a stop position in which the elongated members contact each other, and the piece is resiliently deformed at the living hinges to provide a force resisting movement from an at rest position to a stop position, the blade unit moving up and down along the displacement axis as the elongated members move toward and away from each other. The mounting structure has a second living hinge providing pivoting about the pivot axis, the second living hinge being resiliently deformed to provide a force resisting pivoting about the pivot axis from a neutral position. Planes through the guards and caps of the blade units are generally coplanar when in an at rest position with respect to the displacement axis and at a neutral position with respect to the pivot axis. The cutting edges of blades of the first and second units are generally aligned with each other and have a gap between them, and a third blade unit is offset with respect to the first and second blade units, with its blade overlapping the gap during all positions of pivoting and up and down movement. The blades of the blade units are between ¼" and ¾" long (preferably between ⅜" and ⅝" long, and most preferably about ½" long). The blade units are mounted to resist displacement from an at rest position with a spring constant of between 5 and 30 (preferably between 10 and 29, and most preferably about 15) gm force/mm. The blade units are mounted to resist pivoting about the pivot axis from the neutral position with a spring constant of between 3 and 20 gram-millimeters/radian. The plastic of the mounting structure is an elastomeric polymer, preferably a polyethylene block amide available under the PEBAX trade designation. The integral plastic piece is between 0.008 to 0.018 inch thick (preferably 0.012 to 0.014 inch) at the living hinges providing the up and down movement. The integral plastic piece is between 0.006 to 0.014 inch thick (preferably 0.009 to 0.011 inch) at the living hinge providing pivoting. The mounting structure can also provide pivoting about an angle parallel to the cutting edge. The mounting structure can be mounted at an angle with respect to the handle. Each blade unit has plural blades.

In other aspects, the invention features, in general, a shaving razor handle having a shape that is comfortable and permits a variety of different grips to be used. In one aspect, the upper surface of the handle has an elongated index finger indent that is sufficiently long to support multiple segments of an index finger. In another aspect the lower surface of the handle has an elongated thumb indent that is sufficiently long along a longitudinal axis to support both segments of a thumb oriented along the longitudinal axis. In another aspect, the upper surface of the handle is sufficiently long and the distal region is curved and shaped so as to fit in the palm of a user when an index finger is placed at a proximal region of the upper surface. In another aspect, side surfaces of the handle have a neck region between two wider regions, the neck region being sufficiently long to receive a thumb on one it,side and a plurality of fingers on the other side. The index finger indent is about ⅝" wide and about 2¼" long, and the thumb indent is about 1" wide and about 3" long. The thumb indent has a lip at its distal end to indicate the end of the indent to the user. The thumb indent is scooped as in an axis that is transverse to the longitudinal axis with a sufficient curvature to receive the end segment of a thumb oriented along the transverse axis.

Embodiments of the invention may include one or more of the following advantages. The razor provides a conforming blade system in which the force is evenly distributed over areas of pronounced curvature. There is more blade contact on curved surfaces with the result that shaving is faster and more efficient. There are lower stresses developed with the result that the razor glides smoothly across the surface. The razor is self-adjusting, making it easy to use. The razor conforms to pronounced curvature with application of low forces on the blade units and adjusts to both convex and concave surfaces. The shaving razor maintains local shaving geometry on the skin (e.g., blade angle and exposure), at the same time that it provides more contact and adjusts to the curvature. The composite overall size of the series of blade units is similar in length to an ordinary cartridge. There are no unshaven stripes between the individual blade units. The footprint of the blade units fits into tight areas. The flexure arms deflect in a controlled manner. The individual blade units do not interfere with each other. The razor achieves even load distribution among the individual blade units, providing maximum percentage contact area for each blade unit. The razor has uniform load distribution across each blade unit. The stiffness of the arms is selected to a maintain contact with the skin to thereby avoid vibration. The four-bar linkage provides up and down motion while maintaining the orientation of the plane of the blades cutting edges. The shaving razor provides a smooth, safe and comfortable shave. The handle conforms to fit naturally in the user's hand and accommodates many grip styles. It has soft gripping materials in key locations.

Other advantages and features of the invention will be apparent from the following description of preferred embodiment thereof and from the claims.

BRIEF DESCRIPTION OF THE DRAWINGS

FIGS. 11–15 are perspective views illustrating different hand grip positions when using the FIG. 1 razor.

FIG. 16 is a partial elevation showing the end of a four-bar linkage mounting structure and attached blade unit of an alternative embodiment.

DESCRIPTION OF THE PREFERRED EMBODIMENT

Figure 1:
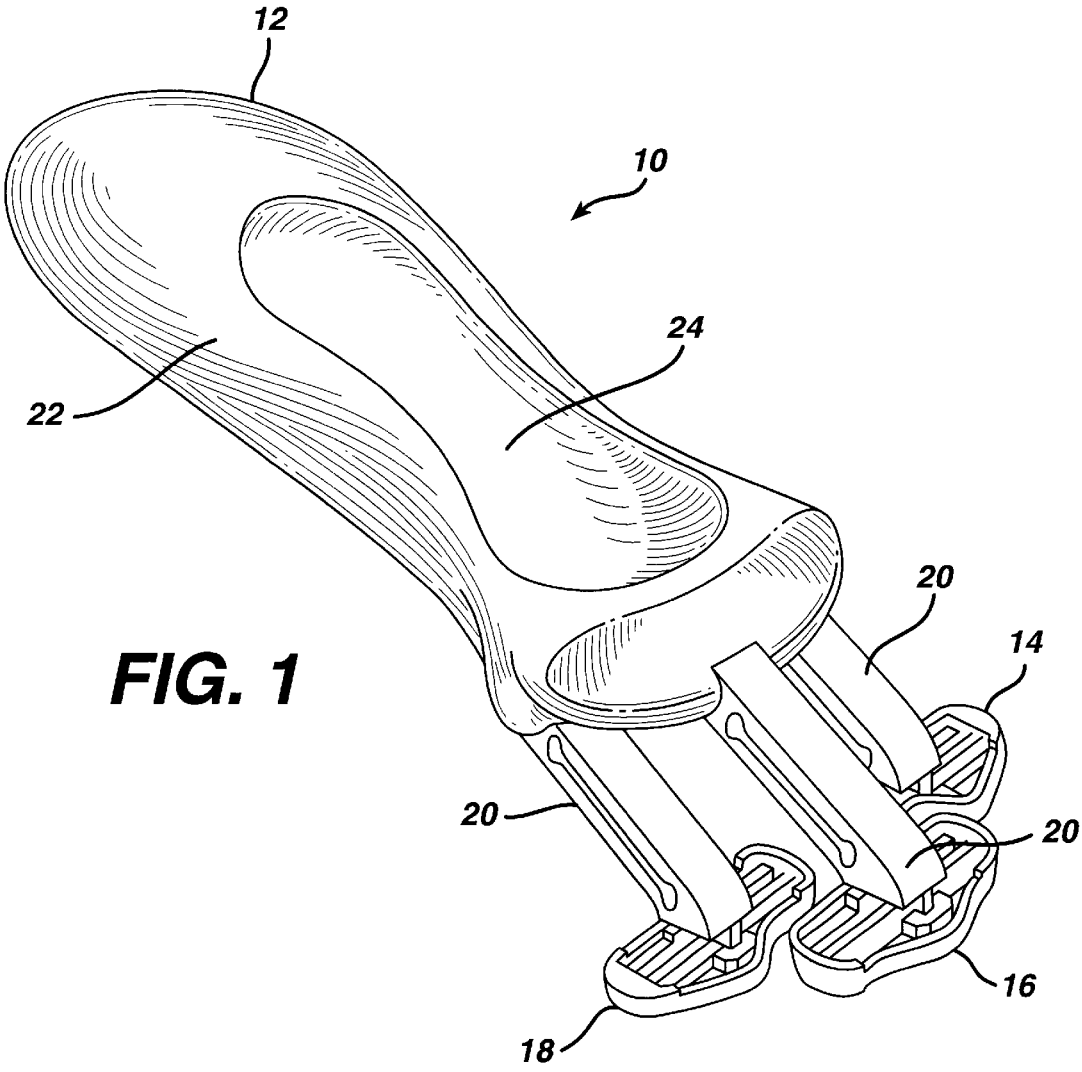
FIG. 1 is a perspective view of a shaving razor.

Referring to FIG. 1, there is shown shaving razor 10 including handle 12 and three-blade units 14, 16, 18 that are each connected to handle 12 by a respective mounting structure 20. Handle 12 has a hard plastic area 22 and elongated index finger indent 24 with an elastomeric surface layer, to be engaged by the index finger or other fingers, depending upon what grip is being used.

Figure 2:
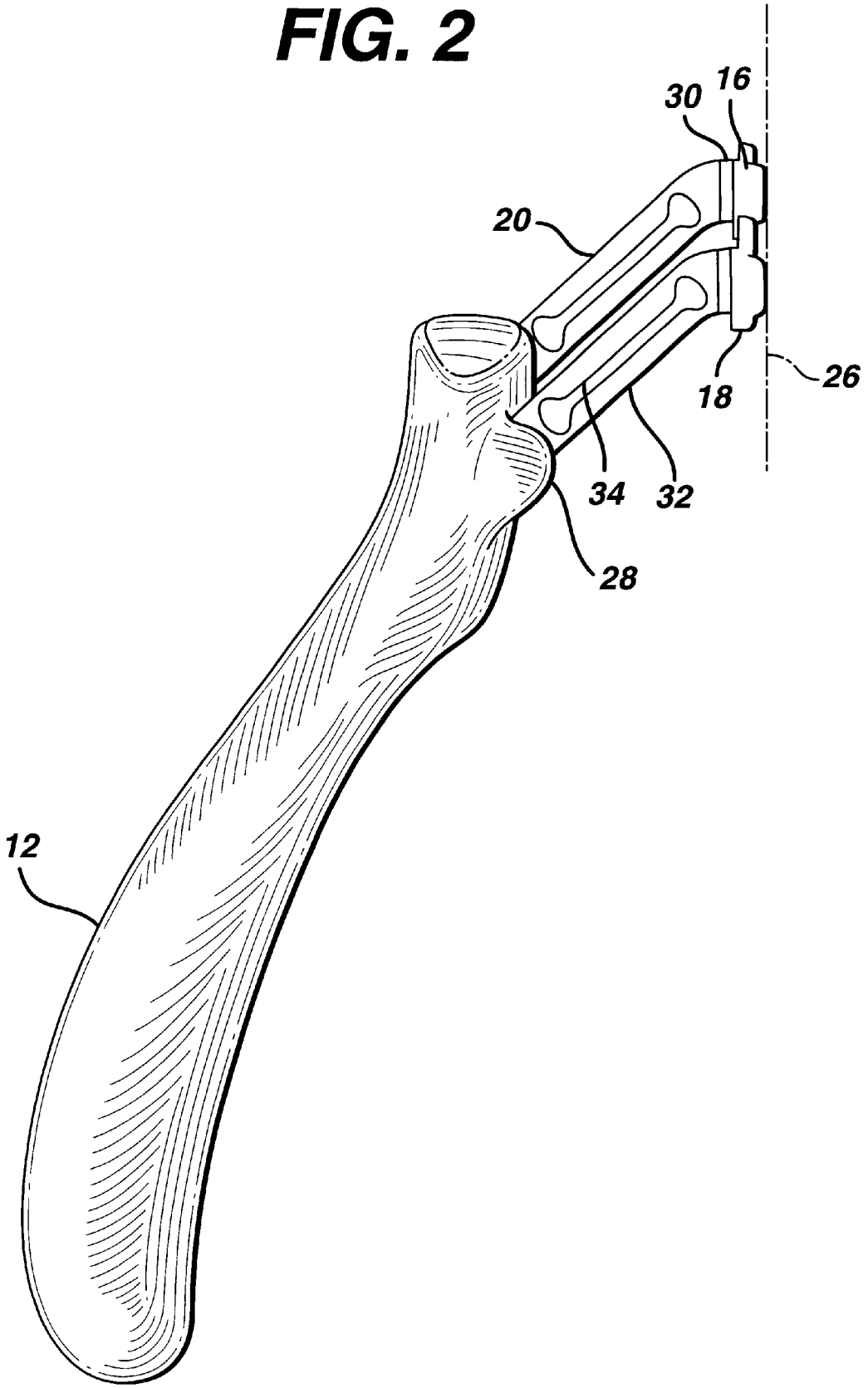
FIG. 2 is an elevation of the FIG. 1 razor.

Referring to FIG. 2, it is seen that in an at-rest condition in which the mounting structures 20 are not flexed, the bottom surfaces of blade units 14, 16, 18 lie in a common plane 26. Each mounting structure 20 includes a proximal end 28 connected to handle 12, a distal end 30 connected to the respective blade unit 14, 16, or 18, and elongated members 32, 34 connecting distal end 30 to proximal end 28.

Figure 3:
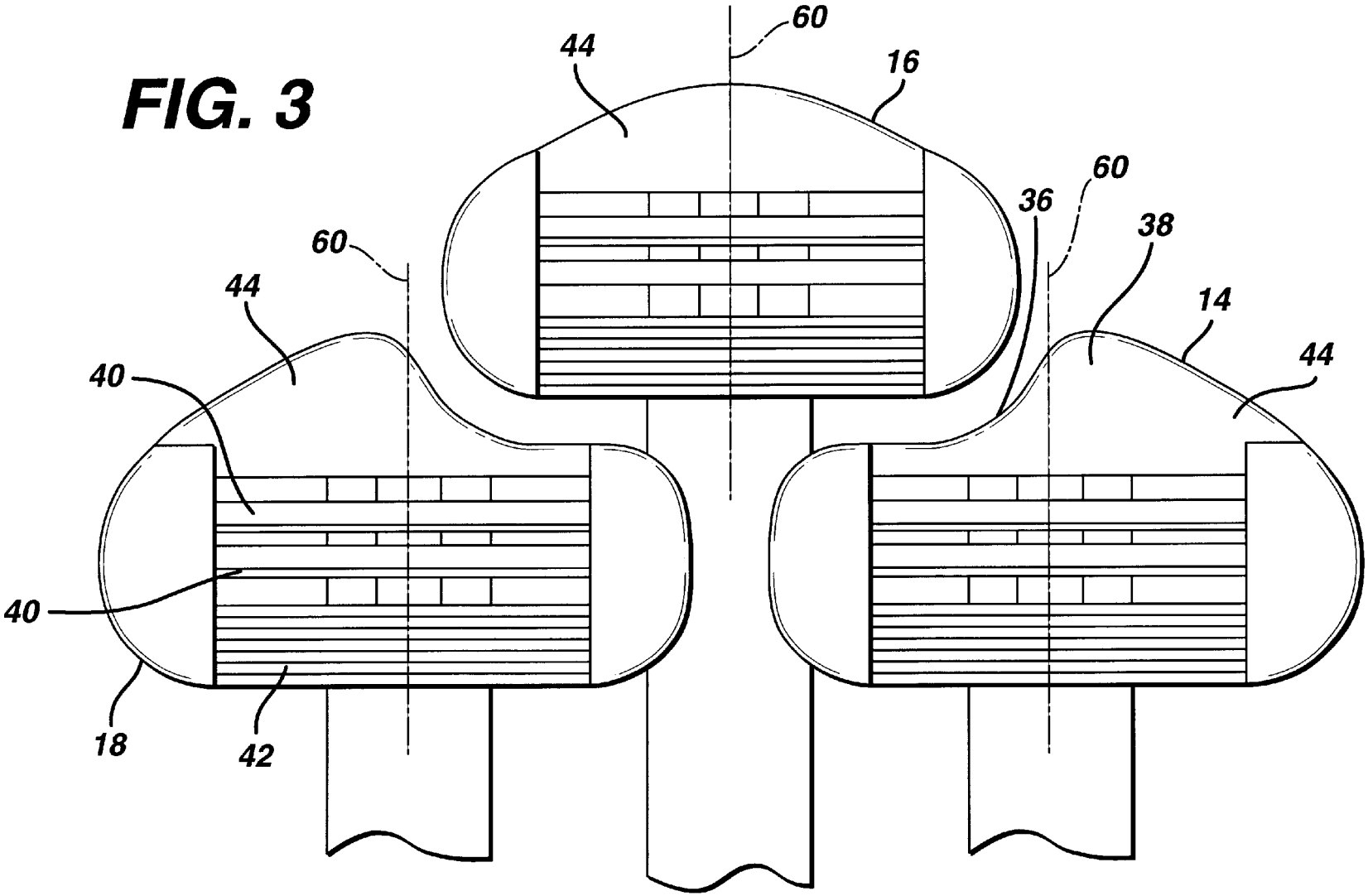
FIG. 3 is a view showing the arrangement, shape and footprint of the blade units of the FIG. 1 razor.

Referring to FIG. 3, it is seen that the following blade unit 16 has a symmetrical shape, while front blade units 14, 18 have cut out portions 36 and extended cap areas 38. Each blade unit includes at least two blades 40 and has finned, elastomeric guard 42 and cap 44. The blades 40 are each about one-half inch long, and the blades in following blade unit 16 overlap the gap that exists between the blades for the two front units 14, 18. The composite overall size length of blade units 14, 16, 18 is similar in length to an ordinary cartridge.

Figure 4:
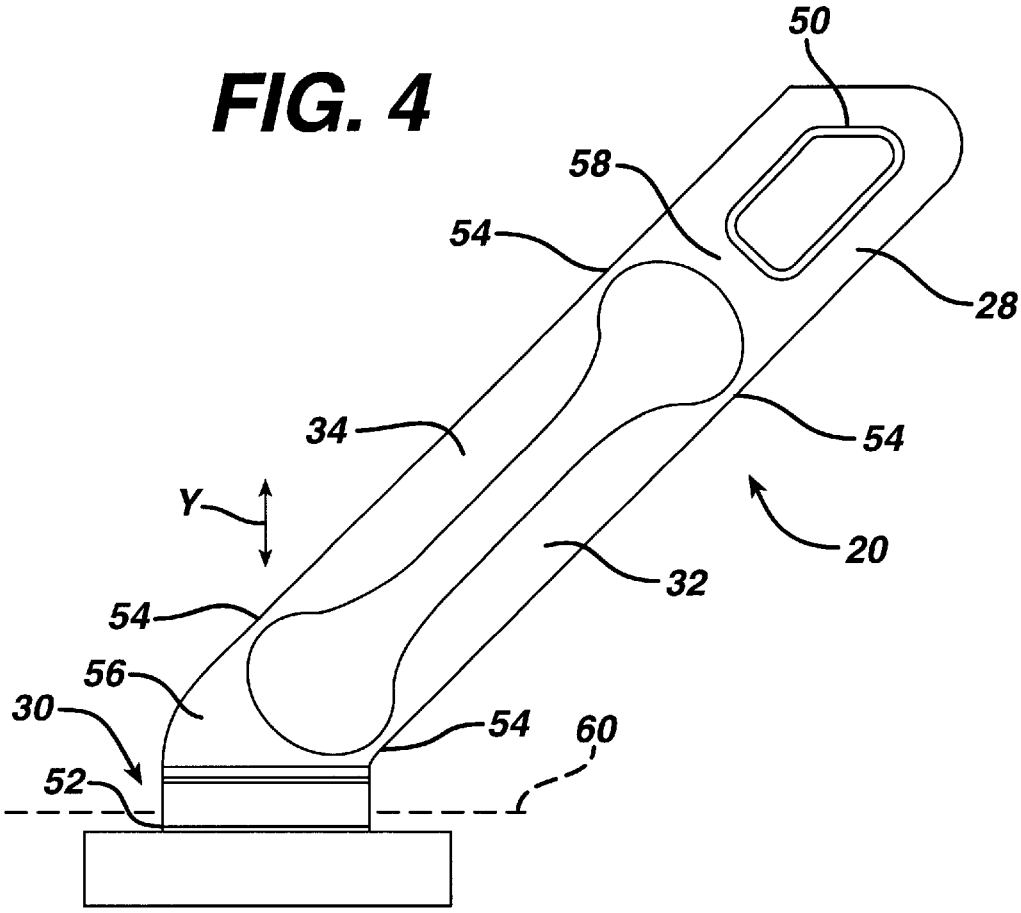
FIG. 4 is an elevation of a four-bar linkage mounting structure and attached blade unit of the FIG. 1 razor in an at-rest position.
Figure 5:
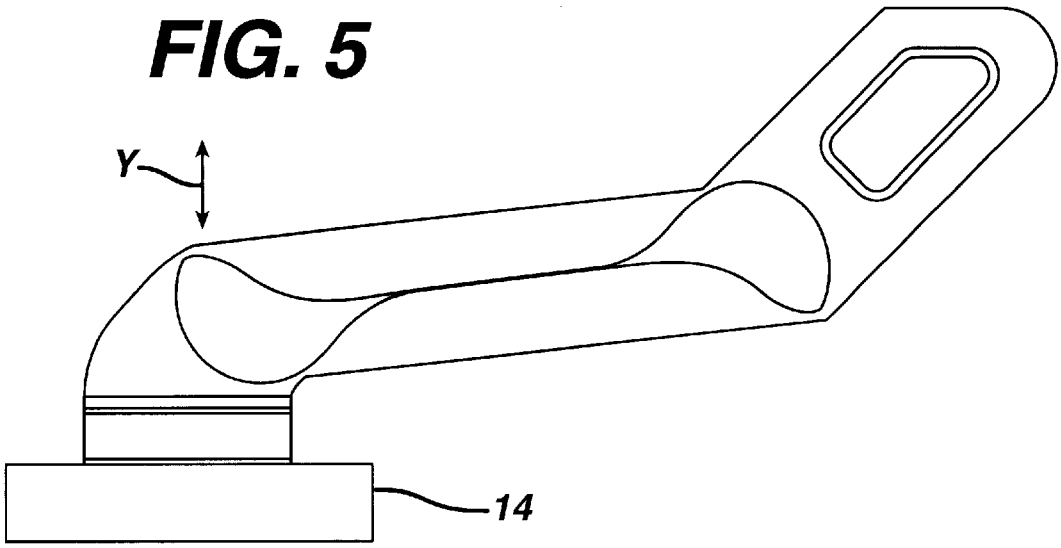
FIG. 5 is an elevation of the FIG. 4 mounting structure and blade unit in a flexed position of maximum vertical displacement.

Referring to FIG. 4, mounting structure 20 is shown in detail. It is made of an integral molded plastic piece of PEBAX, a polyethylene block amide available from Elf Atochem, Birdsboro, Pa., or other elastomeric polymer. Mounting structure 20 includes thinned area 50 to enhance moldability. It also includes connecting members 52 at the distal end 30. Mounting structure 20 has four living hinge sections 54 at which the plastic is gradually thinned to if about 0.0130 inch thick as is shown in FIG. 4. This provides a four-bar, parallelogram linkage structure including elongated members 32, 34, side member 56 at distal end 30, and side member 58 at proximal end 28. This parallelogram four-bar linkage provides controlled displacement such that blade unit 14 will maintain its orientation shown in FIG. 4 as it is displaced upward (e.g., resulting from increased force on the surface of blade unit 14) to the position shown in FIG. 5. The blade units do not rotate about axes parallel to the cutting edges during this up and down movement, and the mounting structures 20 do not bend or twist, providing only up and down movement of the respective blade unit in displacement direction Y, with a slight sideways displacement, as is apparent by comparing the horizontal position of blade unit 14 in FIG. 4 with its position in FIG. 5. Because of this controlled movement, the individual blade units do not interfere with each other and they maintain their relative positions, to guarantee that following unit 16 covers the gap between the blades of front units 14, 18 and avoid stripes. In FIG. 4, mounting structure 20 is shown in an at-rest (i.e., unloaded) position. In FIG. 5, mounting structure 20 is shown at a stop position at which the thicker portions of elongated members 32, 34 abut each other, preventing further upward displacement. Living hinges 54 resiliently deform to provide pivoting and tend to return back to the at-rest position as the displacement force is reduced. The blade units are mounted and mounting structure 20 (including living hinges 54 thereof) are dimensioned and of made of material so as to resist displacement from an at rest position with a spring constant of between 5 and 30 (preferably between 10 and 29, and most preferably about 15) gm force/mm. The blade units are mounted and resilient living hinges 62 are dimensioned and made of material so as to resist pivoting about the pivot axis from the neutral position with a spring constant of between 3 and 20 gram-millimeters/radian.

Figure 6:
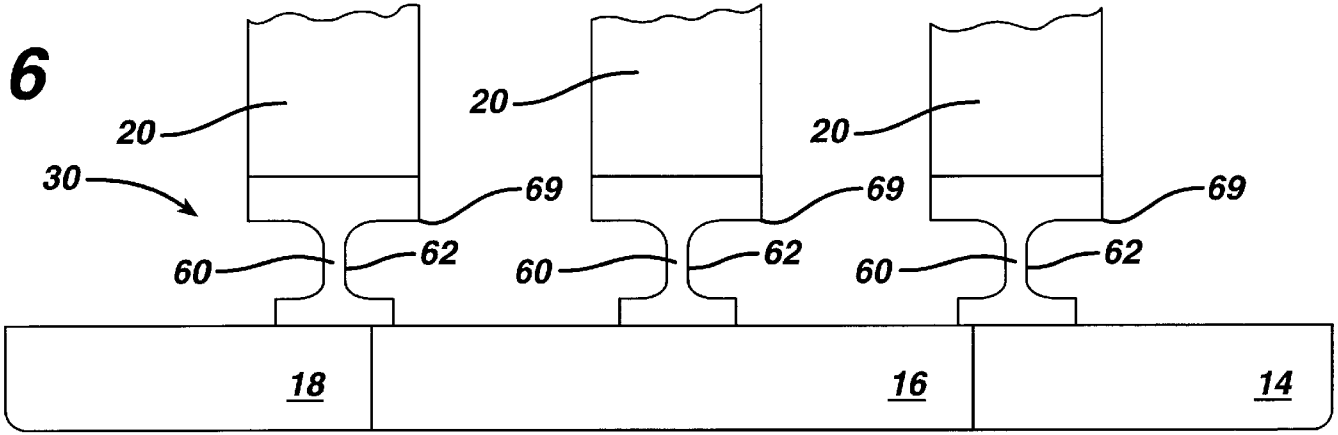
FIG. 6 is a diagrammatic side partial elevation showing the blade units and portions of the mounting structure of the FIG. 1 razor in at rest and neutral pivot positions.
Figure 7:
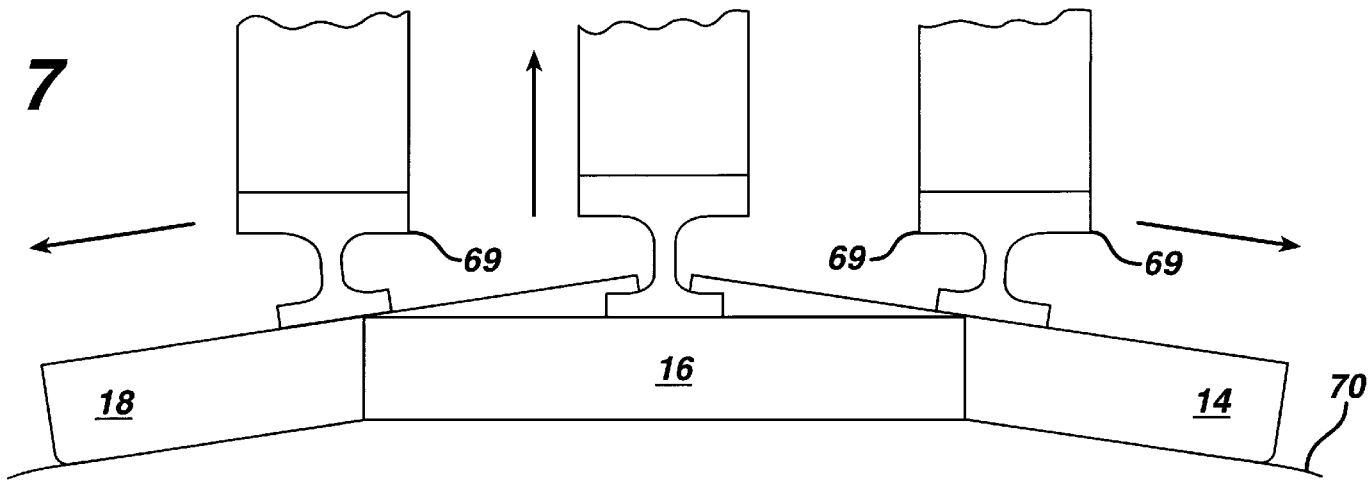
FIG. 7 is a diagrammatic partial elevation showing FIG. 6 blade units at displaced positions and pivot angles while shaving on a curved surface.

Referring to FIGS. 4 and 6, it is seen that distal end 30 of each mounting structure 20 has a living hinge 62 above the respective blade unit 14, 16, 18 to provide rolling of the individual blade units about respective pivot axes 60. In FIG. 6, blade units 14, 16, 18, mounting structures 20, and living hinges 62 are shown in neutral at-rest positions such as they would achieve when they are not being pressed against a surface or when they are uniformly pressed against a flat surface. Living hinges 62 are resilient, and will resiliently return to this position. Corners 69 act as stops, preventing further rotation by interaction with the upper surfaces of respective cartridges. In FIG. 7, the blade units are shown in deflected positions and orientations that result from shaving on curved surface 70. On surface 70, mounting structure 20 for following blade unit 16 has been displaced upward slightly with respect to the other two mounting structures 20, and blade unit 18 has pivoted counter-clockwise at its living hinge 62, while blade unit 14 has pivoted clockwise at its living hinge 62. Each blade unit 14, 16, 18 thus is capable of independent movement both in an up and down displacement direction and in pivoting in order to distribute the contact forces against the surface being shaved and to follow and to conform to the curvature of the surface being shaved. Thus lower stresses result on the cutting edges. The combination of living hinges 54 and living hinges 62 thus permit blade units 14, 16, 18 to roll and move up and down without pitching or yawling Handle 12 matches the natural curvature at rest in human hands, including the curvature at the transverse arch at the base of the palm, the curvature of the transverse arch at the distal end of the palm at the fingers, and the curvature of the longitudinal arch extending from the base of the palm to the ends of the fingers. The at-rest position of the hand is perceived to be the most advantageous for doing work, and the stress-less position of the hand gives the user a feeling of greater control and comfort. In addition, handle 12 is provided with indents and neck regions to permit comfortable gripping in a variety of grip positions, as shown in FIGS. 11–15.

Figure 8:
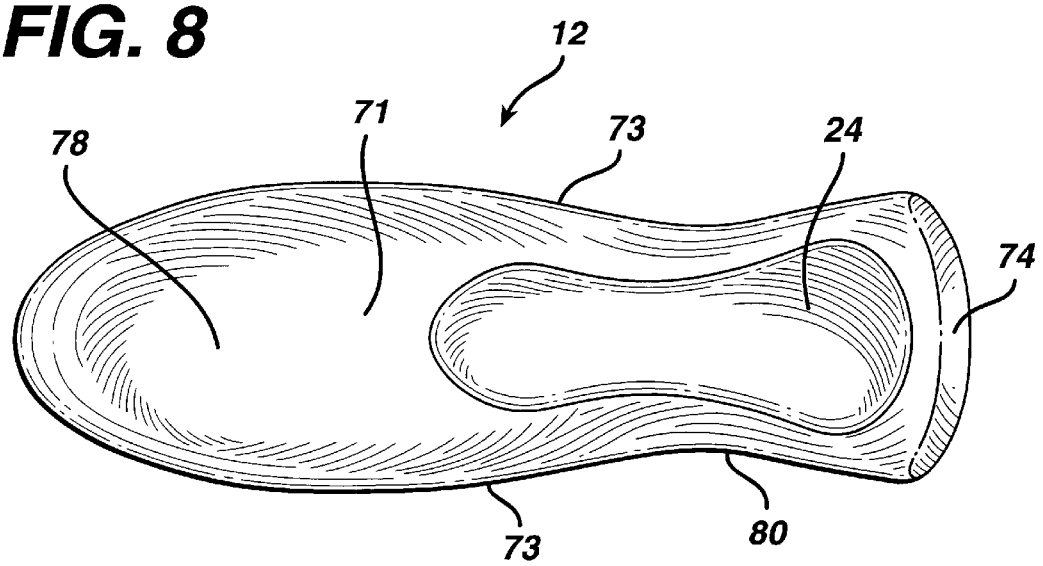
FIG. 8 is a top view of the handle of the FIG. 1 razor.
Figure 9:
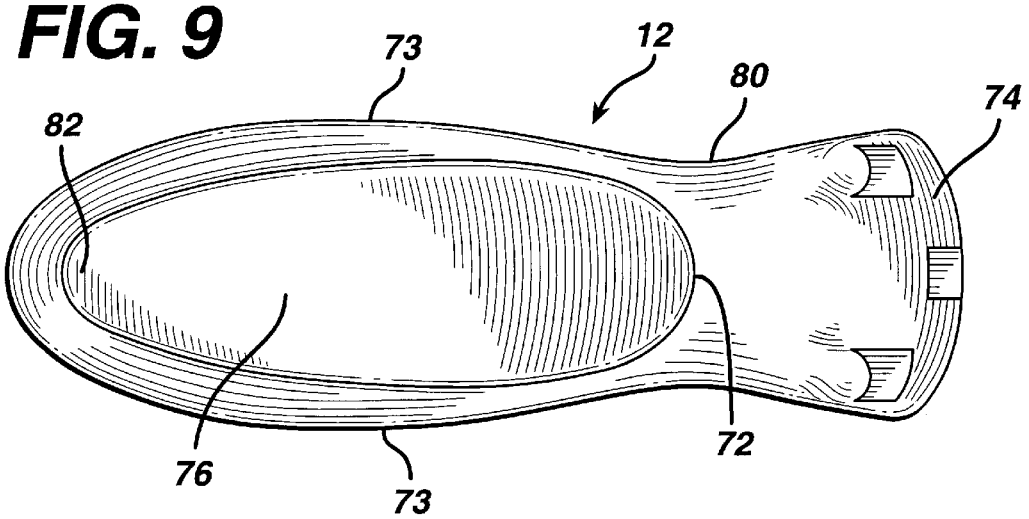
FIG. 9 is a bottom view of the handle of the FIG. 1 razor.
Figure 10:
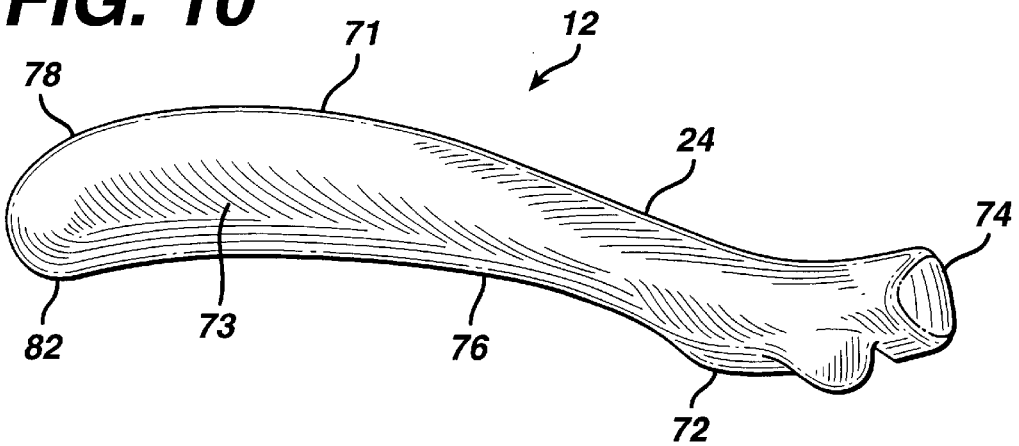
FIG. 10 is a side view of the handle of the FIG. 1 razor.
Figure 11:
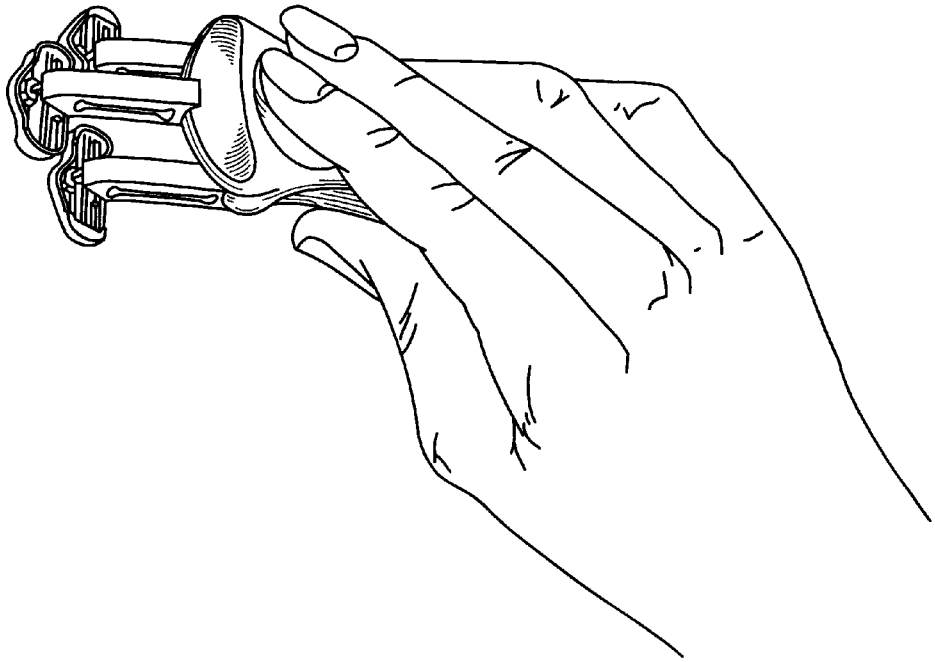
Figure 12:
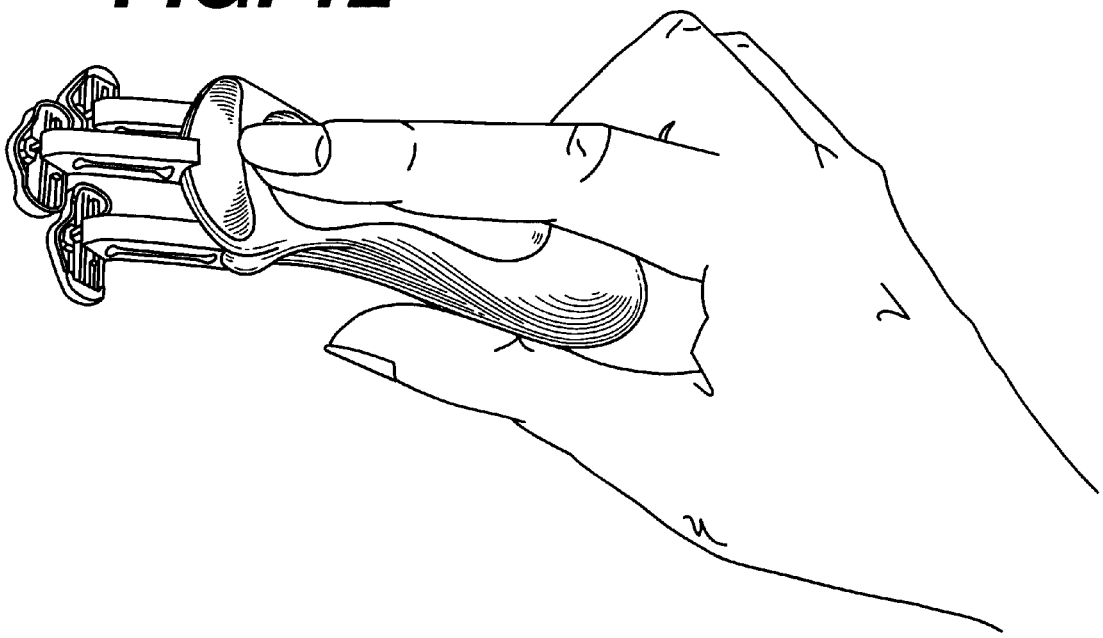
Figure 13:
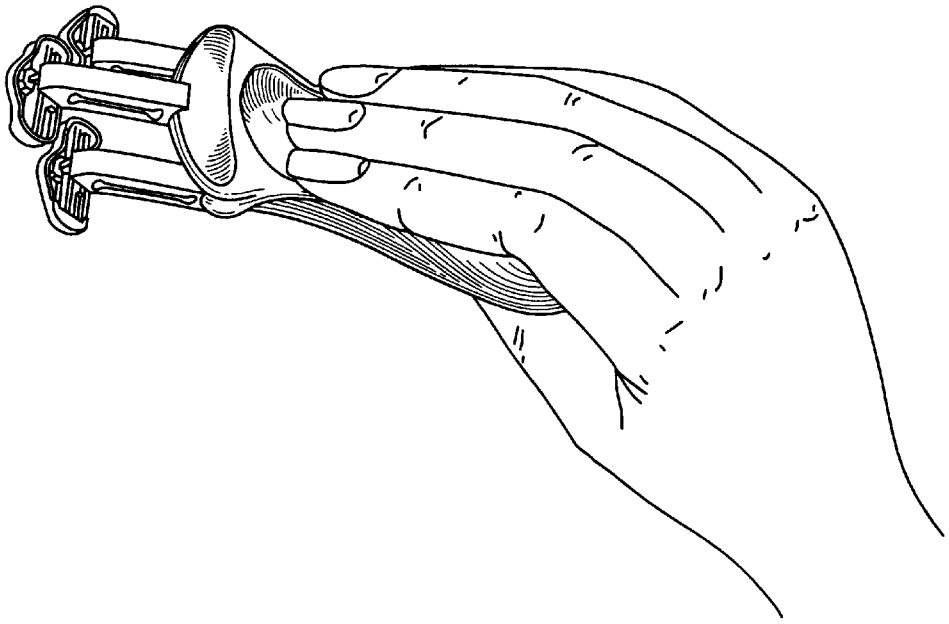
Figure 14:
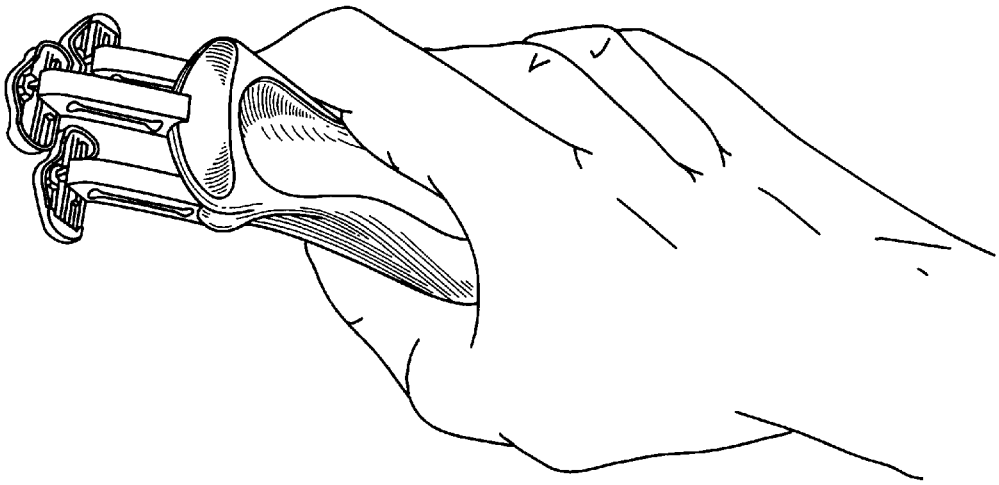

Referring to FIGS. 8–10, handle 12 has upper surface 70, lower surface 72, side surfaces 73, and end 74 for connection to blade units 14, 16, 18. Index finger indent 24 on upper surface 70 is about ⅝" wide and about 2¼" long, which is sufficiently long to support at least two segments of an index finger, providing a greater degree of control. Upper surface 70 also has a curved proximal (with respect to the user's hand) region 78. Upper surface 70 is sufficiently long and proximal region 78 is shaped so that proximal region 78 fits in the palm of a user when an index finger is placed on index finger indent 24; this also provides a more comfortable feel and good control. Lower surface 72 has elongated thumb indent 76 that is about 1" wide and about 3" long, which is sufficiently long along a longitudinal axis to support both segments of a thumb when the thumb is oriented along the longitudinal axis. Thumb indent 76 has lip 82 at its distal end to indicate the end of the indent to the user. Thumb indent 76 is scooped in an axis that is transverse to the longitudinal axis with a sufficient curvature to receive the end segment of a thumb oriented along the transverse axis. Side surfaces 73 converge to provide a neck region 80 between two wider regions. Neck region 80 is sufficiently long and shaped to receive a thumb on one side and a plurality of fingers on the other side.

Referring to FIGS. 11–15, the handle accommodates different grip positions that may be used by different users when shaving different parts of the body, such as the legs, the arms, the underarms, and the bikini area. A first grip position (FIG. 11) involves the thumb at the back of the thumb grip, and multiple fingers wrapped over the upper surface of the handle. A second grip position (FIG. 12) involves holding the distal end of the handle in the palm, with the V between the thumb and index finger being located over upper surface 70. A third grip position (FIG. 13), called the pinch, involves placing the thumb on thumb indent 76 transverse to its longitudinal axis, and the other fingers extending over and transverse to index finger indent 24. A fourth grip position (FIG. 14) involves placing the index finger over the length of the index finger indent 24, the thumb at the neck region 80, and the remaining fingers wrapped around the proximal portion 78. A fifth grip position (FIG. 15) involves placing the thumb over and transverse to the thumb indent 76 at its back, and receiving the curved proximal portion 78 of the handle on the side of a curled index finger.

During shaving, the razor self-adjusts and conforms to both convex (e.g., knees and ankles) and concave (e.g., underarm) surfaces. The individual blade units 14, 16, 18 maintain local shaving geometryon the skin (e.g., blade angle and exposure) at the same time that they independently adjust to the curvature. Only small forces are needed to cause upward displacement, such that there is relatively even load distribution among the individual blade units. Individual blades units 14, 16, 18 have even load distribution across their blades.

Other embodiments of the invention are within the scope of the claims. The mounting structure can also provide pivoting about an axis 100 parallel to the cutting edge as shown for example in FIG. 16. The mounting structure can also provide pivoting about an axis parallel to the cutting edge has shown for example in FIG. 16.

What is claimed is:

1. A shaving razor comprising a handle, first, second and third blade units that are mounted at one end of said handle, each said blade unit including a guard, at least one blade having a cutting edge, and a cap, and a mounting structure connecting each said blade unit to said handle in a predetermined position, said mounting structure providing a pivotal connection of said blade unit to said mounting structure about a pivot axis that is transverse to the cutting edge, and also providing up and down movement of said blade unit along a displacement direction that is transverse to a plane through the guard and the cap, thereby permitting each said blade unit to conform to the contour of a surface being shaved, said first, second and third blade units each having a width that is less than the entire width covered by all three blades, wherein said mounting structure for each said blade unit is independent of mounting structures for the other blade units, permitting each blade unit to pivot about a respective pivot axis and to be displaced along a respective displacement axis independent of the pivoting and displacement of the other blade units, wherein each said mounting structure includes a linkage with two elongated members extending from a proximal end member connected to said handle to a distal end member connected to said blade unit, wherein said linkage forms a parallelogram which includes said two elongated members and also includes a first side member connected between spaced apart proximal ends of said elongated members and to said proximal end member, and a second side member connected between spaced apart distal ends of said elongated members and to said distal end member, said elongated members being pivotally connected at each connection to the first side member and to the second side member.

2. The razor of claim 1 wherein said linkage is formed of an integral plastic piece and includes first living hinges at said connections of said elongated members to said first and second side members.

3. The razor of claim 2 wherein said integral plastic piece has an at rest position in which said elongated members are spaced from each other and a stop position in which said elongated members contact each other, said piece being resiliently deformed at said living hinges to provide a force resisting movement from said at rest position to said stop position, the blade unit moving up and down along said displacement direction as said elongated members move toward and away from each other.

4. The razor of claim 3 wherein said plastic piece is an elastomeric polymer.

5. The razor of claim 4 wherein said plastic piece is a polyethylene block amide.

6. The razor of claim 4 wherein said plastic piece is PEBAX.

7. The razor of claim 3 wherein said integral plastic piece is between 0.008 to 0.018 inches thick at said first living hinges.

8. The razor of claim 3 wherein said integral plastic piece is between 0.012 to 0.014 inches thick at said first living hinges.

9. The razor of claim 2 or 3 wherein said mounting structure includes a second living hinge providing said pivoting about said pivot axis, said second living hinge being resiliently deformed to provide a force resisting pivoting about said pivot axis from a neutral position.

10. The razor of claim 9, wherein said integral plastic piece is between 0.006 to 0.014 inches thick at said second living hinge.

11. The razor of claim 9 wherein said integral plastic piece is between 0.009 to 0.011 inches thick at said second living hinge.

12. The razor of claim 2 or 3 wherein said mounting structure includes a second living hinge providing said pivoting about said pivot axis, said second living hinge being resiliently deformed to provide a force resisting pivoting about said pivot axis from a neutral position, said mounting structure including a stop structure limiting pivoting about said pivot axis.

13. The razor of claim 12 wherein said planes through said guards and said caps of said blade units are generally coplanar when said elongated members are in said at rest positions and said second living hinges are in their neutral positions.

14. The razor of claim 13 wherein the cutting edges of blades of said first and second units are generally aligned with each other and have a gap between them, and a third blade unit is offset with respect to the other two, with its blade overlapping said gap.

15. The razor of claim 13, wherein said third blade unit is located behind said first and second blade units.

16. A shaving razor comprising a handle first, second and third blade units that are mounted at one end of said handle, each said blade unit including a guard, at least one blade having a cutting edge, and a cap, and a mounting structure connecting each said blade unit to said handle in a predetermined position, said mounting structure providing a pivotal connection of said blade unit to said mounting structure about a pivot axis that is transverse to the cutting edge, and also providing up and down movement of said blade unit along a displacement direction that is transverse to a plane through the guard and the cap, thereby permitting each said blade unit to conform to the contour of a surface being shaved, said first, second and third blade units each having a width that is less than the entire width covered by all three blades, wherein the cutting edges of blades of said first and second units are generally aligned with each other and have a gap between them, and a third blade unit is offset with respect to said first and second blade units, with its blade overlapping said gap during all positions of said pivoting and up and down movement.

17. The razor of claim 16, wherein said third blade unit is located behind said first and second blade units.

18. A shaving razor comprising a handle, first, second and third blade units that are mounted at one end of said handle, each said blade unit including a guard, at least one blade having a cutting edge, and a cap, and a mounting structure connecting each said blade unit to said handle in a predetermined position, said mounting structure providing a pivotal connection of said blade unit to said mounting structure about a pivot axis that is transverse to the cutting edge, and also providing up and down movement of said blade unit along a displacement direction that is transverse to a plane through the guard and the cap, thereby permitting each said blade unit to conform to the contour of a surface being shaved, said first, second and third blade units each having a width that is less than the entire width covered by all three blades, said cutting edges of said blade units partially overlapping each other as to avoid gaps between blade units during shaving.

19. The razor of claim 18 wherein said mounting structure for each said blade unit is independent of mounting structures for the other blade units, permitting each blade unit to pivot about a respective pivot axis to be displaced along a respective displacement axis independent of the pivoting and displacement of the other blade units.

20. The razor of claim 19 wherein each said mounting structure includes a linkage with two elongated members extending from a proximal end member connected to said handle to a distal end member connected to said blade unit.

21. The razor of claim 1 wherein said planes through said guards and said caps of said blade units are generally coplanar when in an at rest position with respect to said displacement direction and a neutral position with respect to said pivot axis.

22. The razor of claim 21 wherein said blade units are mounted to resist said displacement from said at rest position with a spring constant of between 5 and 30 gm force/mm.

23. The razor of claim 21 wherein said blade units are mounted and said mounting structure is constructed to resist said displacement from said at rest position with a spring constant of between 10 and 20 gm force/mm.

24. The razor of claim 21 where said blade units are mounted and said mounting structure is constructed to resist said pivoting about said pivot axis from said neutral position with a spring constant of between 3 and 20 gram-millimeters/radian.

25. The razor of claim 18 wherein said blades of said blade units are between ¼" and ¾" long.

26. The razor of claim 18 wherein said blades of said blade units are about ½" long.

27. The razor of claim 18 wherein said mounting structure also provides pivoting about an axis parallel to the cutting edge.

28. The razor of claim 18 wherein said handle is elongated along a longitudinal axis and said mounting structures are oriented in an at rest position at an angle with said longitudinal axis.

29. The razor of claim 18 wherein each said blade unit has plural blades.

30. The razor of claim 18 wherein each said blade unit has movable blades.

31. A shaving razor comprising a handle, a blade unit that is mounted at one end of said handle and includes a guard, at least one blade having a cutting edge, and a cap, and a parallelogram, four-bar linkage connecting said blade unit to said handle, said linkage being made of an integral plastic piece and including two elongated members, a proximal end member connected to said handle, and a distal end member connected to said blade unit, each said elongated member being pivotally connected via resilient first living hinges at respective ends to said proximal end member and said distal end member, said first living hinges providing up and down movement of said blade unit along a displacement axis that is transverse to a plane through the guard and the cap.

32. The razor of claim 31 wherein said integral plastic piece has an at rest position in which said elongated members are spaced from each other and a stop position in which said elongated members contact each other, said piece being resiliently deformed at said first living hinges to provide a force resisting movement from said at rest position to said stop position, the blade unit moving up and down along said displacement direction as said elongated members move toward and away from each other.

33. The razor of claim 31 wherein said linkage includes a second living hinge providing pivoting about a pivot axis that is perpendicular to the cutting edge, said second living hinge being resiliently deformed to provide a force resisting pivoting about said pivot axis from a neutral position, said linkage including a stop structure limiting pivoting about said pivot axis.

34. The shaving razor of claim 18, 31 or wherein said handle comprises an elongated hand gripping structure having an upper surface and a lower surface and an end for connection to a blade unit oriented with the cutting edges directed away from said upper surface, said upper surface having an elongated index finger indent that is sufficiently long to support multiple segments of an index finger.

35. The shaving razor of claim 18, 31 or wherein said handle comprises an elongated hand gripping structure having an upper surface and a lower surface and an end for connection to a blade unit oriented with the cutting edges directed away from said upper surface, said lower surface having an elongated thumb indent that is sufficiently long along a longitudinal axis to support both segments of a thumb oriented along said longitudinal axis.

36. The shaving razor of claim 18, 31 or wherein said handle comprises an elongated hand gripping structure having an upper surface and a lower surface and an end for connection to a blade unit oriented with the cutting edges directed away from said upper surface, said upper surface having a first finger indent and said lower surface having a second finger indent.

37. The shaving razor of claim 18, 31 or wherein said handle comprises an elongated hand gripping structure having an upper surface and a lower surface and an end for connection to a blade unit oriented with the cutting edges directed away from said upper surface, said upper surface having a distal region close to said end for receiving an index finger and a curved proximal region, said upper surface being sufficiently long and said distal region being shaped to fit in the palm of a user when an index finger is placed at said proximal region.

38. The shaving razor of claim 18, 31 or wherein said handle comprises an elongated hand gripping structure having an upper surface and a lower surface and an end for connection to a blade unit oriented with the cutting edges directed away from said upper surface, said elongated hand gripping structure also having side surfaces between said upper surface and said lower surface, said side surfaces having a neck region between two wider regions, said neck region being sufficiently long to receive a thumb on one side and a plurality of fingers on the other side.

* * * * *

UNITED STATES PATENT AND TRADEMARK OFFICE

CERTIFICATE OF CORRECTION

PATENT NO. : 6,308,416 B1 
DATED : October 30, 2001
INVENTOR(S) : Franco Lodato, Brian J. Bosy, Alexander T. Chenvainu, David L. Pappas and Dr. Rajan Ramaswamy It is certified that error appears in the above-identified patent and that said Letters Patent is hereby corrected as shown below:

Column 2,
Line 46, delete "it,".

Column 4,
Line 16, delete "if".

Column 5,
Lines 30, 31 and 57, "70" should be -- 71 --.

Column 6,
Line 4, "geometryon" should be -- geometry on --
Lines 14-16, delete "The mounting structure can also provide pivoting about an axis parallel to the cutting edge has shown for example in FIG. 16."

Column 8,
Line 23, after "other", insert -- so --.
Line 28, after "axis", insert -- and --.

Column 9,
Line 37, change ", 31 or" to -- or 31 --

Column 10,
Lines 1, 11, 20 and 32, change ", 31 or" to -- or 31 --

Signed and Sealed this

Second Day of July, 2002

*Attest:*

*Attesting Officer*

JAMES E. ROGAN
*Director of the United States Patent and Trademark Office*